US006744042B2

(12) United States Patent
Zajfman et al.

(10) Patent No.: US 6,744,042 B2
(45) Date of Patent: Jun. 1, 2004

(54) ION TRAPPING

(75) Inventors: Daniel Zajfman, Rehovot (IL); Oded Heber, Rehovot (IL); Henrik B. Pedersen, Rehovot (IL); Yinon Rudich, Rehovot (IL); Irit Sagi, Rehovot (IL); Michael Rappaport, Rehovot (IL)

(73) Assignee: Yeda Research and Development Co., Ltd., Rehovot (IL)

( * ) Notice: Subject to any disclaimer, the term of this patent is extended or adjusted under 35 U.S.C. 154(b) by 81 days.

(21) Appl. No.: 09/883,841

(22) Filed: Jun. 18, 2001

(65) Prior Publication Data

US 2002/0190200 A1 Dec. 19, 2002

(51) Int. Cl.[7] ..... H01J 49/00

(52) U.S. Cl. ..... 250/287; 250/281; 250/282; 250/290; 250/292; 250/286

(58) Field of Search ..... 250/287, 281, 250/282, 290, 292, 286

(56) References Cited

U.S. PATENT DOCUMENTS 5,880,466 A * 3/1999 Benner ..... 250/281
6,020,586 A * 2/2000 Dresch et al. ..... 250/287

FOREIGN PATENT DOCUMENTS

DE 44 08 489 A 1 3/1994

OTHER PUBLICATIONS

Bateman et al. "Mass Spectrometer", Pub. No: US 20030132377 A1, Pub. Date: Jul. 17, 2003.*

Pub. No: US 2002/0100870 A1, "Charged Particle Trapping in Near–Surface Potentials ", by Whitehouse et al (Aug. 1, 2002).*

Ring, S. et al. "Fourier Transform Time–of–Flight Mass Spectrometry in an Electrostatic Ion Beam Trap" Anal. Chem. vol. 72, p. 4041–4048, (2000).

Zajfman, D. et al. "Electrostatic bottle for long–time storage of fast ion beams" Physical Review A, vol. 55, No. 3, p. R1577–R1580, (1997).

Dahan, M. et al. "A new type of electrostatic ion trap for storage of fast ion beams" Rev. Sci. Instrum. vol. 69, No. 1, p. 76–83, (1998).

Benner, W.H. "A Gated Electrostatic Ion Trap To Repetitiously Measure the Charge and m/z of Large Electrospray Ions" vol. 69, No. 20, p. 4162–4168, (1997).

* cited by examiner

*Primary Examiner*—John R. Lee
*Assistant Examiner*—Zia R. Hashmi
(74) *Attorney, Agent, or Firm*—Ladas & Parry

(57) ABSTRACT

A method for trapping of a plurality of charged particles in a charged particle trap. The trap includes first and second electrode mirrors having a common optical axis, the mirrors being arranged in alignment at two extremities thereof. The mirrors are capable, when voltage is applied thereto, of creating respective electric fields defined by key field parameters. The electric fields are configured to reflect charged particles causing their oscillation between the mirrors. The method includes introducing into the trap, along the optical axis, the plurality of charged particles as a beam having pre-determined key beam parameters. The method further includes choosing the key field parameters for at least one of the mirrors such as to induce bunching among charged particles in the beam.

7 Claims, 4 Drawing Sheets

ION TRAPPING

FIELD OF THE INVENTION

This invention relates generally to the field of charged particle trapping and, in particular, to the use of a charged particle trap for time-of-flight mass spectrometry.

BACKGROUND OF THE INVENTION

Time-of-flight mass spectrometry (TOF-MS) is a process by which charged particles, such as ions, can be separated according to their mass. Assuming all the charged particles have the same energy, they will traverse a fixed distance in different amounts of time depending on their mass. Particles having a larger mass will take more time to travel across the fixed distance, resulting in a spectrum of flight times, from which the masses of the individual charged particles can be determined by a detector. The main advantages of TOF-MS techniques lie in fast acquisition time, high throughput, and virtually unlimited mass range, the latter of which is particularly important for methods of the production of ions of large biological molecules in the gas phase.

It is known that the resolution of TOF-MS instruments can be improved by increasing the length of the flight paths of charged particles before the charged particles are steered into a detector. This is known to be achieved by the multiple folding of the flight path by using electrode mirrors.

U.S. Pat. No. 5,880,466 (U.S. '466) to Benner discloses the trapping of a single, highly charged DNA molecule in an evacuated charged-particle trap, between the trap's two parallel sets of electrode mirrors with applied voltages that establish an electrostatic situation analogous to an optical resonator. The electrode mirrors cycle the charged molecule back and forth many times through a detector tube mounted between the two mirrors. An induced image charge signal whose amplitude is proportional to the molecule's net charge is read by the detector on the molecule's every pass through the detector tube, based on which the molecule's charge, flight time and, consequently, its mass, are determined. It is inherent to any known ion-producing source that successive particles introduced into the trap have an unavoidable range of initial energies, and therefore different flight times even if their masses are equal. Therefore, in order to obtain high resolution of measurement in the charged-particle trap of U.S. '466, the trapping procedure must be repeated a large number of times for which an average time of flight for all the molecules can be statistically attained. Also, in order to produce a signal that can be distinguished by the detector from baseline noise, the single trapped particle must carry a relatively large number of charges. To create a particle having such a large net charge, U.S. '466 makes use of an electrospray ionization (ESI) source.

SUMMARY OF THE INVENTION

The present invention provides for a novel method of simultaneously trapping a plurality of charged particles in a charged particle trap consisting of first and second electrode mirrors having a common optical axis. These mirrors are arranged in alignment at the two extremities of the trap and are capable, when voltage is applied thereto, of creating respective electric fields defined by key field parameters and configured to reflect the charged particles and to keep at least part of them oscillating between the mirrors. The method by which this is performed includes introducing into the trap, along the optical axis, a beam of charged particles having pre-determined key beam parameters, and establishing such field parameters, for at least one of the mirrors, as to cause bunching among charged particles in the beam.

By the 'key beam parameters', it is meant the main properties of the beam, such as the number of charged particles in the beam, charge on the particles in the beam, length, density, radius, and volume of the beam, energy and velocities of the particles in the beam. For the purposes of the present description, the length of the trap is also considered a key beam parameter since the oscillation frequency of the beam is dependent thereof. By the 'key field parameters', it is meant such main properties of the electric fields created by the mirrors as the number of electrodes in each electrode mirror, the geometrical arrangement of the electrodes, and the voltage applied to the electrodes.

By 'bunching', it is meant a synchronization effect, believed to have been discovered by the authors of the present invention, in which oscillating ions having like charges and slightly different velocities when reflected by an electric field of a certain configuration, surprisingly move together, despite the Coulombie repulsion force acting between the ions, the slightly different velocities of the ions and the various path lengths over which the ions can be stored.

The method of the present invention is particularly useful when applied in TOF-MS, because it enables the detection and measurement of a plurality of charged particles, in spite of the particles' having a range of energies unavoidably created by an ion-producing source. Thereby, the necessity is avoided of repeating the trapping procedure for one particle after another, as in U.S. Pat. No. 5,880,466.

If a bunch of charged particles were introduced into the trap in the manner described in the prior art reference, the bunch would quickly expand until its time of flight could no longer be detected. The method of achieving the bunching phenomenon of the present invention prevents a bunch of charged particles oscillating within the trap from its natural expansion and allows for the prolonged oscillating flight time of the bunch necessary for high resolution in TOF-MS. Therefore, the trapping time of a plurality of charged particles becomes limited only by the extent of evacuation in the trap. Bunching not only facilitates the spectrometry process by allowing a plurality of particles to be simultaneously measured, thereby requiring less time and effort to perform the process, it also allows for each charged particle in the bunch to carry but a single or double charge, because collectively, the particles have a net charge large enough to produce a discernible signal. The latter aspect is of particular importance because it enables the trap to detect all kinds of particles of equal charges, regardless of their mass and charge. Thus, ion sources producing bunches of singly or doubly charged particles, such as matrix-assisted laser desorption/ionization (MALDI), may be used. MALDI is more popular and much more prevalent than the ESI technique used in U.S. Pat. No. 5,880,466.

BRIEF DESCRIPTION OF THE DRAWINGS

In order to understand the invention and to see how it may be carried out in practice, a preferred embodiment will now be described, by way of non-limiting example only, with reference to the accompanying drawings, in which.

DETAILED DESCRIPTION OF EMBODIMENTS OF THE INVENTION

Figure 1:
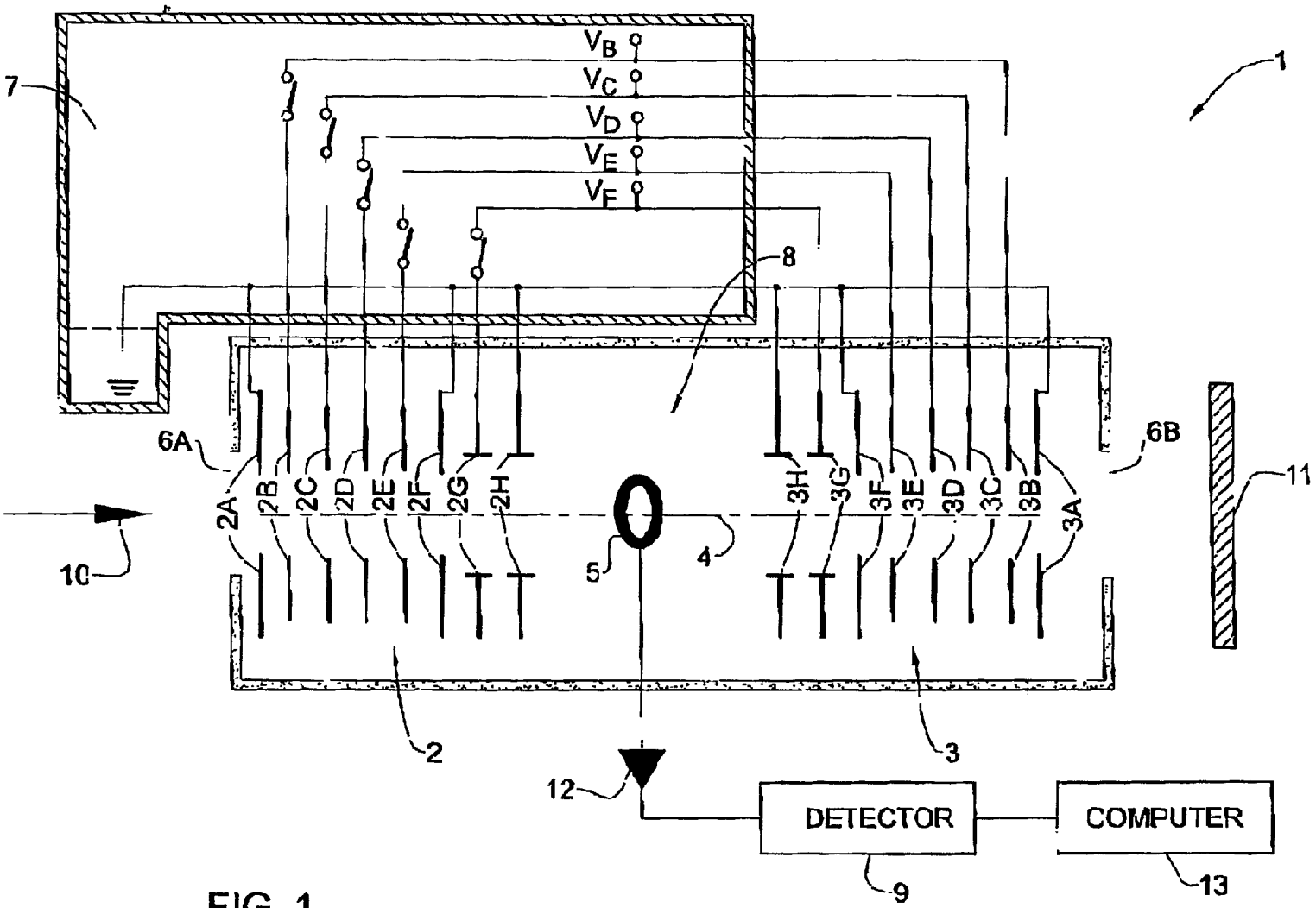
FIG. 1 is a schematic cross-sectioned view of an ion trap designed to produce ion trapping of the present invention.

An ion trap 1 in accordance with the present invention is schematically shown in FIG. 1. It is adapted to work as a time-of-flight mass spectrometer with an ion beam 10 produced by an ion producing source (not shown) based on any appropriate method of ion production, which may for example be electrospray ionization (ESI) or matrix-assisted laser desorption/ionization (MALDI) mentioned above. The ion beam 10 is composed of ions having a distribution of initial kinetic energies, the average initial kinetic energy being of a given value $E_k$. The beam 10 is defined by key beam parameters which include the number of ions in the beam 10, charge on the ions in the beam 10, length, density, radius, and volume of the beam 10, average energy and velocities of the ions in the beam 10 and the length of the trap 1.

The interior of the trap 1 is evacuated and it includes first and second electrode mirrors 2 and 3 having a common optical axis 4 and arranged in alignment at two extremities thereof. The mirrors 2 and 3 have respective apertures 6A and 6B, of which one (6A) constitutes an entrance through which the beam 10 is to be introduced into the trap 1 along the optical axis 4.

The trap 1 also includes a charge-detecting element 5 situated between the mirrors 2 and 3 and a low-noise charge-sensitive amplifier 12 electrically connected to the detecting element 5 to amplify a signal induced by a flux of net charge about the detecting element 5. The trap further comprises a detector 9 such as a digital oscilloscope or a frequency analyzer for recording the signal from the amplifier 12, and a computer 13 to further analyze the signal. Outside the trap 1, and facing at least one of the apertures 6A and 6B, is a micro-channel plate detector 11, able to detect impacting particles leaving the trap 1.

Each mirror 2,3 is made of a respective set of electrodes 2A–2H, 3A–3H, which are electrically connected to a voltage controller 7, allowing for the application of voltage to the electrodes 2A–2H and 3A–3H and its adjustment thereof. Each electrode 2A–2H, 3A–3H is adapted to be maintained at a constant yet adjustable voltage by the voltage controller 7, rendering the mirrors 2 and 3 capable of creating respective electrostatis fields, the configuration of which is defined by key field parameters. These parameters include the number of electrodes 2A–2H, 3A–3H in each electrode mirror 2,3, the geometrical arrangement of the electrodes 2A–2H, 3A–3H and the voltage applied to the electrodes 2A–2H, 3A–3H. The innermost electrodes 2H and 3H are grounded to ensure that a central region 8 between the mirrors 2 and 3 is free of electric field.

In operation, to enable the ion beam 10 to enter the trap 1 through the aperture 6A of the electrode mirror 2, this mirror 2 is initially grounded, while the voltage on the opposing mirror 3 is kept at some constant magnitude. Once the ion bunch is inside the trap 1, the voltage on the entrance mirror 2 is switched on, and the ions become trapped. The voltages applied to the electrodes of the mirrors 2 and 3 create electric fields configured to reflect ions of the beam 10, causing their oscillation between the mirrors 2 and 3. With the applied voltage, the electrode mirrors 2 and 3 behave similarly to optical mirrors and each has a focal area within the central region 8 of the trap 1, to which each mirror 2,3 deflects ions that travel generally parallel to the optical axis 4.

To perform measurements, the trapping time, or storage lifetime, of the ions in the trap should be as long as possible. Experiments have shown that in order for the trajectories of the trapped ions to be stable so that they oscillate a maximum number of times, the focal area of each mirror 2,3 must be located at a distance that is not less than one-fourth the length of the trap 1 away from that mirror. In practice, the maximum number of oscillations depends on the extent of evacuation in the trap 1 since ions in the oscillating bunch collide with any residual gas in the trap 1 and consequently become neutral. Neutral particles leave the trap 1 through one of the apertures 6A and 6B, thereby limiting the storage lifetime of the trapped bunch of ions. The number of neutral particles leaving the trap 1 through aperture 6B is detected by the micro-channel plate detector 11, based on which the storage lifetime of the bunch can be determined.

The time it takes each ion to travel from one mirror 2,3 to the other is the oscillation time of that ion. Each ion has a slightly different oscillation time and the spread in these times per oscillation for all of the ions comprised in the beam 10 is denoted herein by $\Delta T$. If this beam 10 is initially introduced a bunch into the trap 1 in a conventional manner, the spread $\Delta T$ will increase in time. When the spread $\Delta T$ is still small and the ions continue travelling as a bunch, the ions, upon each oscillation, induce an image charge on the charge-detecting element 5, which produces a signal proportional to the net charge of the bunch and corresponds to its oscillation frequency. From these measurements, the ions' average flight time, and therefore their mass to charge ratio (m/z) can be derived.

The signal induced by the oscillating ion bunch on the charge-detecting element 5 can be characterized by its width and integral. Since the length of the stored bunch is larger than the length of the charge-detecting element 5, the width of the signal W (see FIG. 2A) is proportional to the length of the stored ion bunch, and the integral of the signal is proportional to the number of ions in the bunch.

The gradual increase of $\Delta T$ in a conventionally used trap results in the expansion or lengthening of the bunch, since ions with smaller oscillation times move away from those with larger ones and the bunch eventually spans the length of the trap 1, at which point the margins of the bunch will no longer be distinguishable by the detector 9, and measurement is no longer possible.

The authors of the present invention have realized that specific measures can be taken to prevent the lengthening of the bunch and that these measures should be directed to reducing $\Delta T$. They have also realized that $\Delta T$ may, in fact, be split into two components, both of which lead to the expansion of the ion bunch, but result from different factors.

The first factor is the range of ion velocities $\Delta V$ in the bunch, which leads to a shorter oscillation time for faster moving ions than for slower ones and which is best represented by a spread or distribution about a mean value v. The size of this distribution mainly depends on the range of energies with which the ions enter the trap 1, and is due to the properties and mode of operation of the ion-producing source. Such a velocity spread yields a corresponding time spread for each oscillation of the bunch, which we denote as $\Delta T_v$. This component is a function of the key beam and field parameters.

The second factors is the diversity of stable ion trajectories in the trap 1. The mirrors 2 and 3 of the trap 1, like optical mirrors, have a certain amount of aberration, which results in some ions travelling a longer distance between the mirrors 2 and 3 than others. Ions travelling close to the optical axis 4 of the trap 1 have a slightly shorter oscillation period than ions travelling farther away from the axis 4. The time spread per oscillation due to this intrinsic property of the trap 1 is designated by $\Delta T_a$, and it also depends on the key beam and field parameters.

Assuming that the interaction between the ions is negligible, and that $\Delta T_v$ and $\Delta T_a$ are independent, the total time spread $\Delta T$ for each oscillation of the bunch in the trap 1 is given by:

$$\Delta T=[(\Delta T_a)^2+(\Delta T_v)^2]^{1/2} \quad \text{(Eq.1)}$$

Under these assumptions, the bunch length $X_n$ should increase as a function of the number of oscillations n in the trap 1 according to the following equation:

$$X_n=(X_0^2+n^2\Delta T^2)^{1/2} \quad \text{(Eq.2)}$$

where $X_0$ is the initial length of the bunch at the time of its introduction into the trap 1.

Between the two factors, $\Delta T_a$ is, in general, the dominant one, but both can be estimated using a computer simulation program where the trajectories of the ions can be calculated by solving Newton's equation of motion under the influence of the electric field generated by the various voltages $V_B$, $V_C$, $V_D$, $V_E$, $V_G$ on the electrodes 2A–2H, 3A–3H. Since there exist more than one set of voltages $V_B$, $V_C$, $V_D$, $V_E$, $V_G$ applied to the electrodes 2A–2H, 3A–3H for which stable ion trajectories can be attained, it is possible to independently change both $\Delta T_v$ and $\Delta T_a$ to achieve different trapping states. This is done by choosing key beam and field parameters that result in various voltage gradients $V_B$, $V_C$, $V_D$, $V_E$, $V_G$ in the regions of the mirrors 2 and 3 of the trap 1.

To reduce the total time spread $\Delta T$, key beam and field parameters should be chosen such as to reduce $\Delta T_a$ and $\Delta T_v$. The reduction of $\Delta T_a$ may be achieved by choosing a field configuration with a larger optical aberration, so that only those ions located close to the optical axis 4 of the trap 1 are trapped with stable trajectories. This reduces the value of $\Delta T_a$, and consequently $\Delta T$, causing the local density of ions at the turning points of the ion trap 1 to be strongly increased, i.e. minimizing at these points, the distance between the ions comprised in the bunch. To reduce $\Delta T_v$, the key beam and field parameters are to be chosen to have compensation properties so that ions with slightly larger velocities will penetrate the mirror region 2,3 deeper, spending more time in that region than slower moving ions. This also minimizes the distances between the ions. In particular, experiments show that by adjusting the voltage gradient of the mirrors 2 and 3, such compensation can be achieved that the effect of the initial velocity distribution can be cancelled ($\Delta T_v \approx 0$).

Experiments show that by taking the above measures, the rate of expansion for the bunch may be made to practically vanish, in complete disagreement with theory. In other words, the average bunch length may remain constant for the duration of the storage lifetime despite the fact that Eq. 2 predicts such a result only for $\Delta T$ equal to zero. This phenomenon indicates that the ions, under these new conditions, move in a correlated way.

One possible explanation of the above surprising behavior of the trapped ions is that a kind of synchronization phenomenon may be induced, referred to herein as 'bunching', where each of the oscillating ions stored in the trap 1 interacts through its Coulomb field with all the other oscillating ions of the bunch and it is the mutual repulsive Coulomb interaction itself, assumed to be negligible in the preceding theoretical development, which provides the coupling needed for bunching to take place.

To summarize the above, to induce this synchronization behavior between the ions, one or both of the two components, $\Delta T_a$ and $\Delta T_v$, has to be adequately reduced, and the distance between the ions should be minimized and kept at this minimum until bunching occurs. Considering these variables and based on the key field and key beam parameters, a computer can be programmed to give the optimal conditions necessary to achieve bunching. By allowing the average length of the bunch to be kept indefinitely constant, bunching significantly prolongs the possible measurement time of the bunch oscillation frequency, making the trap 1 capable of high-resolution mass spectrometry.

In order to understand the effect of the Coulomb interaction between the ions, the authors have developed a simple one-dimensional simulation model, which takes into account the relevant parameters of the ion trap system. A straightforward simulation would include the trajectory calculations of tens of thousands of interacting particles in the trap 1. Since this is a major computational effort, the authors have used two different approaches. In the first approach, it was assumed that the collision details, such as the strength and type of force acting between the particles, are unimportant, and it was supposed that after each oscillation, when the ion bunch reaches the turning point in the electrostatic mirror 2,3, a strong randomization, or mixing, of velocities takes place. The assumption of strong mixing in the mirror regions 2 and 3 is valid because of the increase of ion density when the ions slow down in these parts of the trap 1. Such a mixing produces an exchange of trajectories and velocities among the different ions such that, for each oscillation, the period of oscillation of each trapped ion is randomized from a distribution whose average is around the mean oscillation period, and the width is given at $\Delta T$. Under these assumptions, it is possible to demonstrate that the length of the bunch is essentially independent of the number of oscillations, if $\Delta T$ is sufficiently small.

The second approach is based on the mean field approximation, where the bunch of ions is represented by a homogeneously charged sphere with a diameter equivalent to the bunch length used in the experiment. The motion of a singly charged test particle, in this case chosen to be an argon ion with an initial kinetic energy of 4.2 kcV, is then monitored when it interacts with this sphere. The force between the test charge and the sphere is assumed to be the result of the homogeneous charge distribution, meaning that the force is zero if the test charge is located at the center of the sphere, and increases linearly until the distance of the test charge from the center is equal to the radius of the sphere. At a larger distance, the force between the test charge and the sphere decreases with the square of the distance, as expected from Coulomb's law. The initial velocity of the sphere was chosen to be close, but not equal, to that of the test charge, and the two moved in a potential free region of about 200 mm, bounded by external potential walls which could be either linear or quadratic. When the sphere reached the non-zero potential regions, its diameter was reduced smoothly in order to take into account the natural increase of density due to the velocity reduction, as happens in the trap 1.

The equations describing the motion of this system were solved numerically and the relative distance between the center of the charged sphere and the test charge was recorded as a function of time. It was found that for a variety of different initial conditions, such as relative initial velocities and positions, if the sphere had a critical charge representing a minimum number of argon ions, the relative distance was bound to a value smaller than the radius of the sphere. This means that the system was, on average, phase locked so that expansion did not occur. For charges on the sphere lower than the critical charge, the test charge and the sphere were found to separate and their relative phase charged continuously. Also, for large initial velocities of the test charge relative to the sphere, locking could not be achieved. It must be pointed out that this simple model does not prove directly that the experimental observation of phase locking is only due to the Coulomb interaction between the stored particles, and that other effects dependent on the field configuration might contribute to achieving such phase locking.

Referring again to FIG. 1, it is well known that TOF-MS instruments have a resolution that is limited by the length of the free flight or central region 8. The ion trap 1 described above may be viewed as an extremely long time-of-flight mass spectrometer, which prevents bunch expansion. It is therefore capable of competing with the expensive and more sophisticated Fourier Transform Ion Cyclotron Resonance Mass Spectrometry (FTICR MS) instruments, where very high mass resolutions are obtained due to the long-time observation of the motion of ions in a uniform magnetic field, and to the independence of the measured frequency on the initial velocity distribution of the ions. The linear trap 1, when using bunching in accordance with the present invention, may be used to achieve mass resolution comparable to the popular FTICR MS instruments.

Experimental results obtained in an ion trap 1 according to the present invention are now discussed below. The ion trap 1 in the experiments was comprised of two identical mirrors 2 and 3, each in the form of a stack of eight, ring electrodes 2A–2H, 3A–3H, mounted on a rod assembly. The distances between the electrodes were measured to be 6 mm and the length of the trap was 407 mm. The central region 8 of the trap 1 was kept field free and at ground voltage. The voltages on the electrodes linearly increased from 2F to 2A in the entrance mirror 2, and from 3F to 3A in the opposing mirror 3. The electrodes 2F and 2H were grounded and together with the electrode 2G, which was maintained at a constant voltage $V_G$, they operated as an asymmetric Einzel lens. The opposing mirror 3 had its electrodes 3F and 3H grounded, while 3G was maintained at the voltage $V_G$, also constituting an asymmetric Einzel lens. The mirrors 2 and 3 confined the ions in the longitudinal direction, and the voltage $V_G$ on the Einzel lenses was chosen so that stable ion trajectories were achieved. The geometrical design of the ion trap and the voltage settings were developed using Simion 6.0, ion source computer software that gives ion trajectory simulations. To achieve a high vacuum, the trap 1 was pumped by a cryo pump at a rate of 2000 L/S and the internal pressure was maintained below $10^{-9}$ Torr. Further, a micro-channel plate detector 11 was mounted at one end of the trap 1, approximately 1.2 meters away from its center.

A beam of Argon ions $Ar^+$, having an average initial kinetic energy of 4.2 keV was introduced into the trap 1 through one of its apertures 6A or 6B. At this energy, the oscillation frequency of the ion bunch in the trap 1 was about 340 kHz. The thin, annular charge-detecting element 5 having a length of 7 mm and a diameter of 18 mm, was mounted at the center of the trap 1. Ion bunches passing through this element 5 induced an image charge which was amplified by the low-noise charge-sensitive amplifier 12. The signal was then shaped and digitized by the detector 9, which was a digital oscilloscope, and Fourier transformed (FT) by the computer 13 to obtain a frequency spectrum. Examples of the observed signals are presented in FIGS. 2A–2C and FIGS. 3A–3C for different time windows after the introduction of a bunch containing about $10^5$ $Ar^+$ ions into the trap 1.

The bunch length was determined by the action of a fast electric chopper located upstream of the ion-producing source. The chopper gave a value of 130 ns, which corresponds to an effective initial bunch length of $X_0$=18 mm, and a beam density of $1.4\times10^5$ ions/cm$^3$. The electron impact ion-producing source that was used gave a relatively narrow distribution of velocities $\Delta v$ estimated by the manufacturer to be $\Delta v/v<0.1\%$. The storage lifetime was monitored by the micro-channel plate detector 11, which showed that the beam intensity decreases exponentially with time.

Figure 2A:
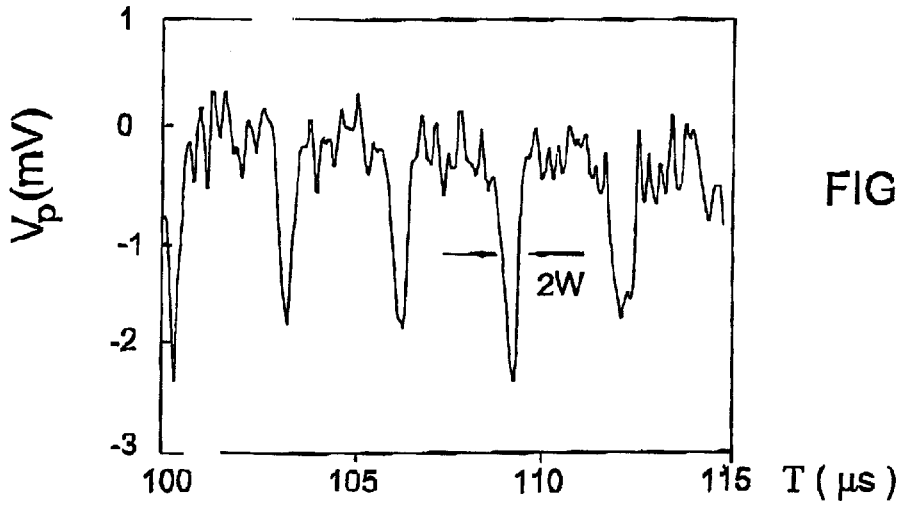
FIGS. 2A–2C show the observed signal induced by the oscillating bunch of ions for three different consecutive time windows in a first experiment, where the ion trapping is performed in a manner different from the present invention.
Figure 2B:
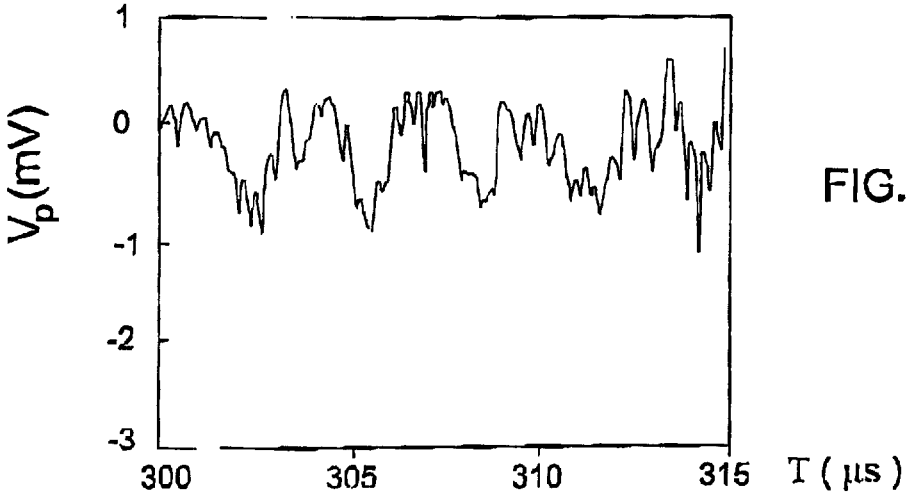
Figure 2C:
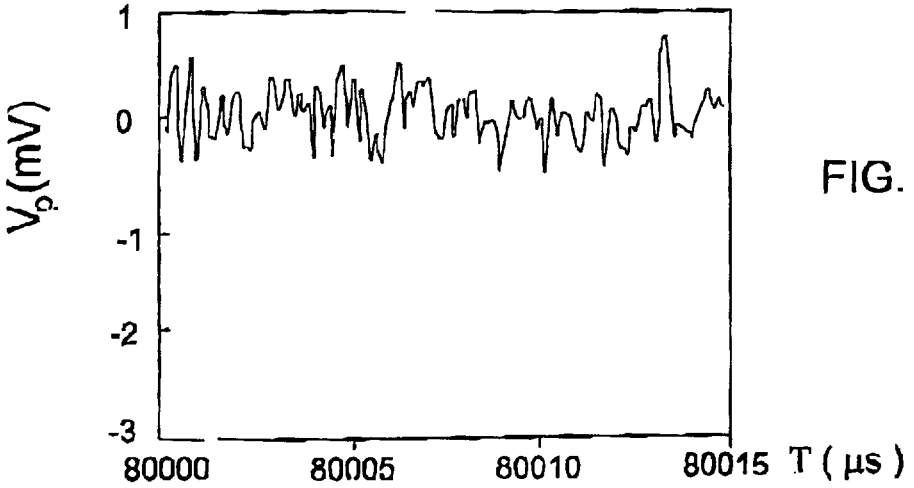

The bunch length was measured as a function of time for two experiments having different field configurations. In the first experiment, voltages of $V_B$=6.5 kV, $V_C$–4.875 kV, $V_D$=3.25 kV, $V_E$=1.625 kV, $V_G$=3.35 kV on mirror electrodes 2A–2H and 3A–3H were applied using the voltage controller 7. Those voltages gave time spreads calculated by Simion 6.0 were $\Delta T_a$=3.56 ns and $\Delta T_v$=0.18 ns, yielding an overall time spread per oscillation of $\Delta T$=3.57 ns. The maximum beam radius for which stable ion trajectories could be achieved for this configuration was calculated, again using Simion 6.0, to be 3.6 mm. FIGS. 2A–2C show the measured signal for three different time windows: between 100 and 115 $\mu$s after the initial injection of the bunch, between 300 and 315 $\mu$s thereafter, and between 80,000 and 80,015 $\mu$s thereafter, respectively. It is clear from FIGS. 2A–2C that the signal broadens and disappears after a few hundred microseconds of trapping due to the expansion of the bunch. It is important to point out that the disappearance of this signal is not due to the finite lifetime of the ion beam 10 because of the residual gas pressure. In fact, this was monitored using the micro-channel plate detector 11, and was found to be of the order of 160,000 $\mu$s.

Figure 4:
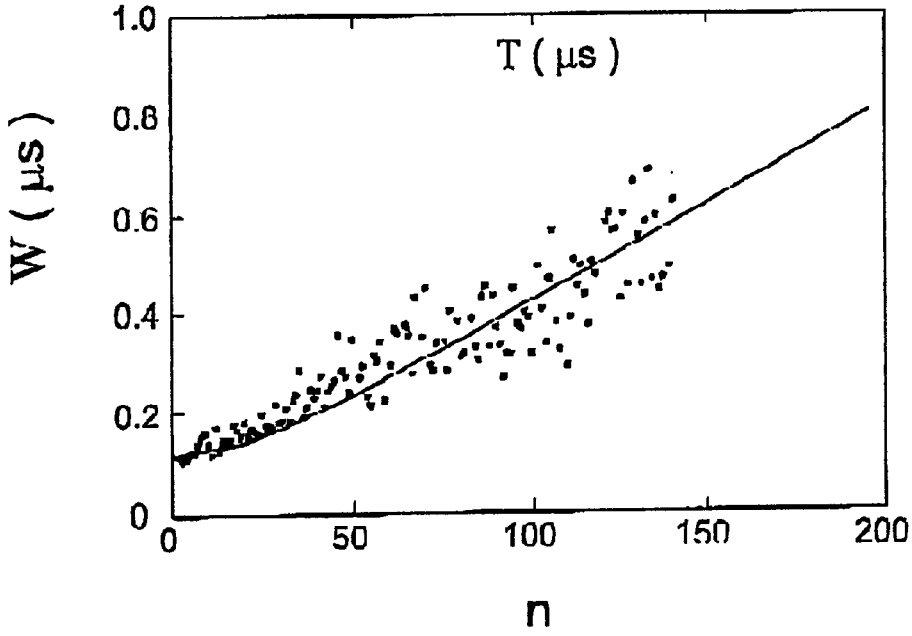
FIG. 4 shows the theoretical (solid line) and experimental values of the bunch length in the first experiment illustrated in FIGS. 2A–2C as a function of both time and number of oscillations.

FIG. 4 shows the time evolution of the bunch length for the first experiment, as obtained by fitting the peaks of the measured signal with a Gaussian function. Also shown in FIG. 4 is a solid line representing the theoretical expectation of the bunch length as predicted by Eq. 2 using the calculated value of $\Delta T$=3.57 ns. It can be seen that the calculated, theoretical values of the curve are in very good agreement with the plotted, measured values. Measurement of the signal width W for times greater than 450 $\mu$s after initial injection of the bunch was not possible due to the rapid spread of the pulses and their mutual overlap which can be seen in FIGS. 2B and 2C.

Figure 3A:
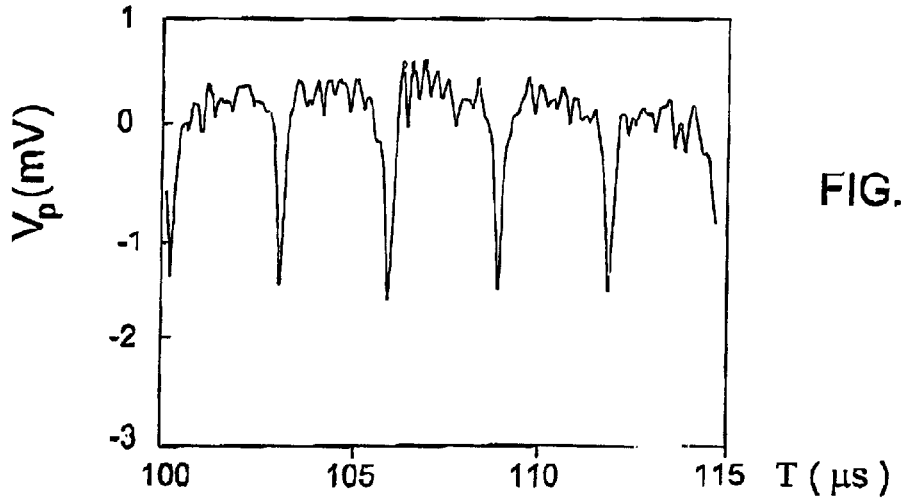
FIGS. 3A–3C show the observed signal induced by the oscillating bunch of ions for three different consecutive time windows in a second experiment, where the ion trapping of the present invention is performed.
Figure 3B:
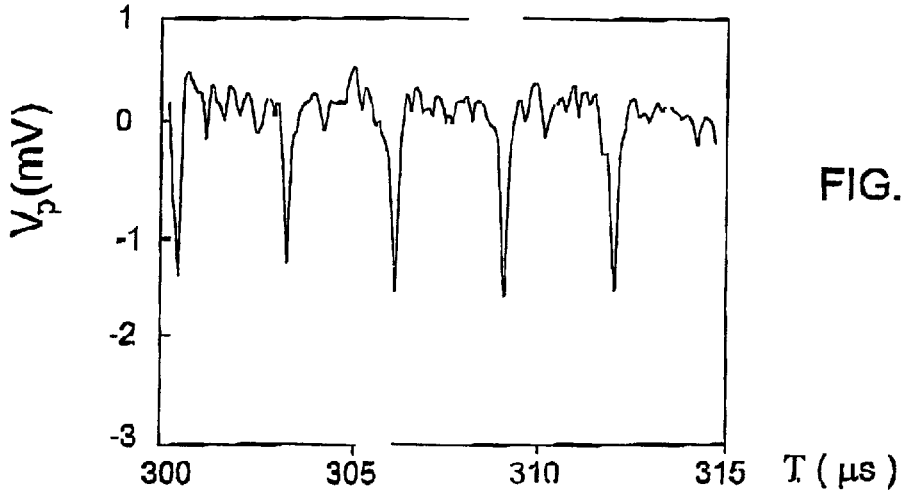
Figure 3C:
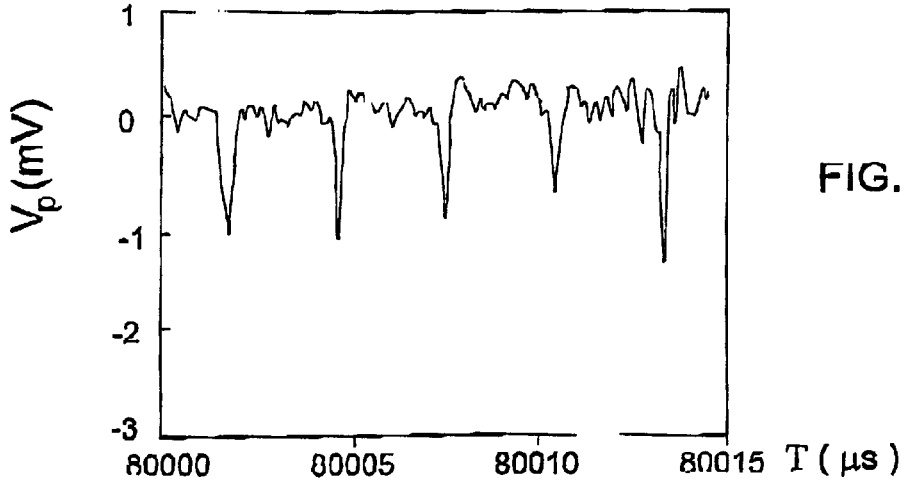

In the second experiment, the voltages of the electrodes were adjusted to $V_B$–5.8 kV, $V_C$=5.26 kV, $V_D$=4.73 kV, $V_E$=4.2 kV, $V_G$=4.36 kV, producing a field configuration for which a total time spread of $\Delta T$=0.18 ns was calculated using Simion 6.0. FIGS. 3A–3C show the observed signal for the three different time windows of 100 to 115 $\mu$s, 300 to 315 $\mu$s and 80,000 to 80,015 $\mu$s respectively. It is clear from FIGS. 3A–3C that the signal remains present for a much longer time; the width W seems to remain constant, while the pulse height (or integral) is decreasing. This decrease is due to the loss of ions from the bunch caused by the collisions with the residual gas in the trap 1, for which a lifetime of 164 ms can be extracted by analyzing the time dependence of the pulse area.

Figure 5:
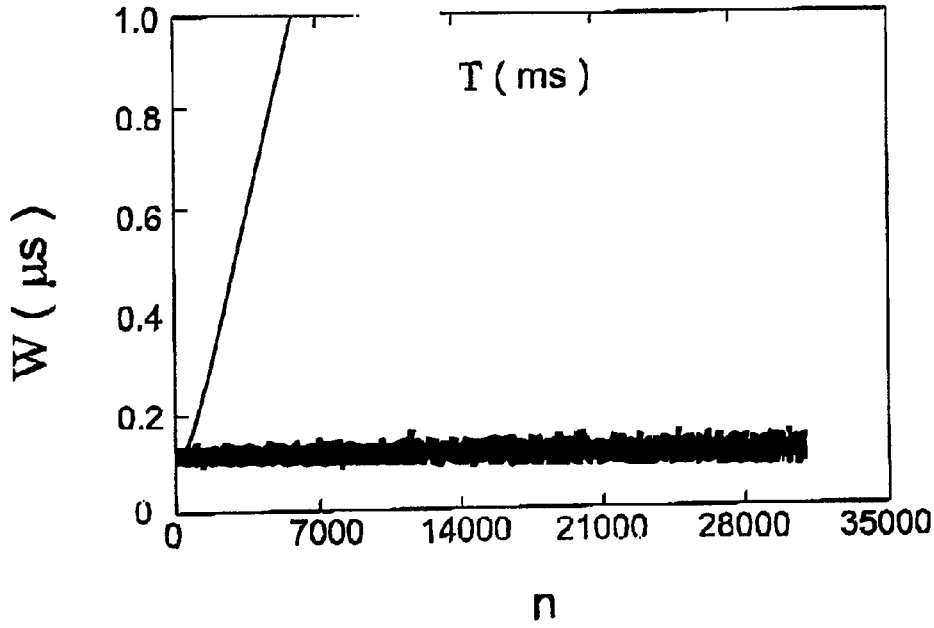
FIG. 5 shows the theoretical (solid line) and experimental values of the bunch length in the second experiment illustrated in FIGS. 3A–3C as a function of both time and number of oscillations.

FIG. 5 shows the measured time evolution of the bunch length for the second experiment. It should be noted that the abscissa scale has been changed as compared to FIG. 4 in order to highlight the new conditions. The solid line in FIG. 5 is the expected bunch length $X_u$ calculated using Eq. 3 and $\Delta T$–0.18 ns. This calculated bunch length shows an expected increase as a function of time, which is much slower than for the field configuration of the first experiment (see FIG. 4). This increase, however, is very much faster than, and in complete disagreement with, the measured bunch length that, surprisingly, remains constant over the 100 ms shown here.

Although the oscillation time spread has been reduced by a factor of 20, from $\Delta T$–3.57 ns to $\Delta T$–0.18 ns, the experimental result shown in FIG. 5 is totally unexpected. The complete lack of time dependence of the bunch length is in clear contrast with the predictions of Eq. 1. The frequency spread on the ions, which was 0.12% for the field configuration of the first experiment, was reduced to 0.0061% in the second experiment.

A simple estimation of the resolution of our system can be obtained by fitting the peaks shown in FIGS. 3A–3C. The average time of the last measured peak (not shown), after t=100 ms of trapping, could be fit with an error bar of $\Delta t=10$ ns. This leads to a mass resolution of $\Delta m/m=2\ \Delta t/t=2\times10^{-7}$ for an average mass m=40. A preliminary check was also made by inspecting the Fourier transform of the signal shown in FIGS. 3A–3C, with an observation time of 100 ms. A peak at a frequency of 340.5 kHz was obtained, but due to the limited resolution of our frequency analyzer, the real width could not be measured properly. The width of the signal was given by a single bin of the analyzer, so that the bind size, 3 Hz, was used as the upper limit of the frequency width. Since resolution increases with measurement time, and discernable signals for storage lifetimes on the order of tens of seconds are possible, we can expect very high frequency/mass resolution. For comparison, recent measurements made at the experimental storage ring based on the Schottky noise of stored nuclei have reached a mass resolution of $\Delta m/m=2.8\times10^{-6}$ for an average mass m=200.

It should be understood that the above described embodiment is only one example of an ion trap and method for achieving bunching therein according to the present invention, and that the scope of the present invention fully encompasses other embodiments which may become obvious to those skilled in the art. For example, charged particles other than ions may be trapped according to this method. Also, the field and beam parameters may be altered, and bunching may be achieved using any kind of electromagnetic field. The present invention could also serve purposes other than mass spectrometry.

What is claimed is:

1. A method for trapping of a plurality of charged particles in a charged particle trap including first and second electrode mirrors having a common optical axis, and arranged in alignment at two extremities of the particle trap, the mirrors being capable, when voltage is applied thereto, of creating respective electric fields defined by key field parameters and configured to reflect charged particles causing oscillation of the particles between the mirrors, said method comprising the steps of:

(a) introducing into the trap, along the optical axis, said plurality of charged particles as a beam having predetermined key beam parameters, said particles having a spread $\Delta T$ in the oscillation time of the particles per oscillation, said spread $\Delta T$ having a first component $\Delta T_v$, caused by a range of velocities at which said particles are introduced into the trap, and a second component $\Delta t_a$, caused by heterogeneity of trajectories of said particles in the trap resulting from aberration of the mirrors; and (b) inducing bunching among said particles, wherein the step of inducing bunching includes choosing said key field parameters for at least one of the mirrors so as to reduce one or both of the components $\Delta T_v$ and $\Delta T_a$ and to minimize the distance between the particles until the bunching occurs.

2. A method according to claim 1, wherein said step of choosing said key field parameters comprises creating a large aberration in said at least one of the mirrors so that only charged particles located close to the optical axis are trapped with stable trajectories.

3. A method according to claim 1, wherein said step of choosing said key field parameters comprises adjusting at least one of said key field parameters.

4. A method according to claim 1, further comprising the step of determining, using a computer, optimal conditions necessary to achieve said bunching, based on said key held parameters and said key beam parameters.

5. A method according to claim 1, wherein said charged particle trap includes a detector for producing a signal indicative of frequency of oscillation of the bunch of charged particles therethrough, for performing time-of-flight mass spectrometry.

6. A method according to claim 1, in which said step of choosing said key field parameters produces said electric fields to keep an average length of the bunch constant.

7. A method according to claim 1, wherein said bunching is induced between the oscillating ions due to the mutual repulsive Coulomb interaction that provides the coupling needed for the bunching to take place.

* * * * *

UNITED STATES PATENT AND TRADEMARK OFFICE

CERTIFICATE OF CORRECTION

PATENT NO. : 6,744,042 B2
DATED : June 1, 2004
INVENTOR(S) : David Zajfman et al.

It is certified that error appears in the above-identified patent and that said Letters Patent is hereby corrected as shown below:

Title page,
Item [*] Notice, “81” should read -- 178 --.

Signed and Sealed this

Twenty-seventh Day of July, 2004

JON W. DUDAS
*Acting Director of the United States Patent and Trademark Office*

UNITED STATES PATENT AND TRADEMARK OFFICE

CERTIFICATE OF CORRECTION

PATENT NO. : 6,744,042 B2
DATED : June 1, 2004
INVENTOR(S) : Daniel Zajfman et al.

It is certified that error appears in the above-identified patent and that said Letters Patent is hereby corrected as shown below:

Title page,
Item [75], Inventors, "David Zajfman" should be -- Daniel Zajfman --

Signed and Sealed this

Twenty-sixth Day of October, 2004

JON W. DUDAS
*Director of the United States Patent and Trademark Office*